United States Patent [19]

Ettischer et al.

[11] Patent Number: 4,696,615

[45] Date of Patent: Sep. 29, 1987

[54] COPYING MACHINE

[75] Inventors: Helmut Ettischer, Ostfildern; Arno Ebner, Stuttgart; Rolf Munz, Kernen; Raimund Pollak, Eislingen, all of Fed. Rep. of Germany

[73] Assignee: Eastman Kodak Company, Rochester, N.Y.

[21] Appl. No.: 802,109

[22] Filed: Nov. 25, 1985

[30] Foreign Application Priority Data

Nov. 28, 1984 [DE] Fed. Rep. of Germany ..... 3443362

[51] Int. Cl.[4] ..... B65H 1/30

[52] U.S. Cl. ..... 414/114; 53/381 R; 83/483; 83/924; 83/926 R; 271/3.1; 271/157; 355/3 SH; 414/32; 414/119; 414/131; 414/412; 414/413; 414/416

[58] Field of Search ..... 414/32, 112, 114, 115, 414/117, 118, 119, 126, 131, 403, 411, 412, 413, 416, 417; 83/483, 909, 912, 924, 926; 30/2; 271/3.1, 157; 221/11, 31, 293; 29/33.52, 564.3; 355/3 SH; 53/381 R, 492

[56] References Cited

U.S. PATENT DOCUMENTS

| | | | |
|---|---|---|---|
| 1,330,639 | 2/1920 | Leumann | 221/293 |
| 3,386,320 | 6/1968 | Pinkham et al. | 414/412 X |
| 3,391,806 | 7/1968 | Geis et al. . | |
| 3,934,150 | 1/1976 | Matsumoto et al. | 414/412 |
| 3,963,790 | 2/1975 | Kamarek | 414/412 |
| 4,285,625 | 8/1981 | Yamada | 414/412 |
| 4,339,221 | 7/1982 | Mitzel et al. | 414/114 |
| 4,526,501 | 7/1985 | Blumle | 414/32 |
| 4,531,878 | 7/1985 | Tamura | 414/412 |
| 4,553,312 | 11/1985 | Mitzel et al. | 83/924 X |
| 4,556,210 | 12/1985 | George | 271/157 |
| 4,580,938 | 4/1986 | Mojden et al. | 414/119 |
| 4,586,232 | 5/1986 | Ohmura et al. | 83/909 X |

FOREIGN PATENT DOCUMENTS

| | | | |
|---|---|---|---|
| 366263 | 2/1932 | United Kingdom | 53/381 R |
| 2047663 | 12/1980 | United Kingdom | 271/3.1 |

*Primary Examiner*—Leslie J. Paperner

*Attorney, Agent, or Firm*—Lawrence P. Kessler

[57] ABSTRACT

In a supply magazine of a copying machine closed copy paper packages are arranged in stacked relation. The copy paper has been preconditioned by the manufacturer and provided with a packing that protects the preconditioning.

Whenever the copy paper supply for the copying machine has to be refilled, one copy paper package is removed from the supply magazine and advanced to an unpacking device and opened.

The unpacked copy paper stack is withdrawn from the opened packing by a withdrawing device and moved to a magazine.

The magazine is associated with a sheet separating device which removes individual sheets and advances them to the copying station.

7 Claims, 31 Drawing Figures

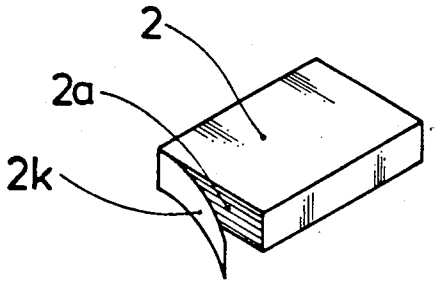
Fig. 29
Fig. 30
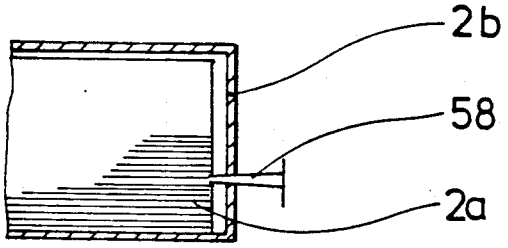
Fig. 31
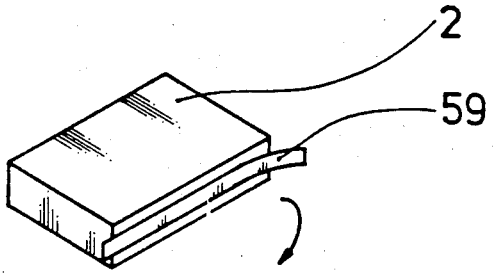

COPYING MACHINE

FIELD OF THE INVENTION

The invention relates to a copying machine having a copy paper supply magazine in which copy paper sheet stacks are used that have been removed from a package closed all around and which are associated with a sheet separating device.

DESCRIPTION OF THE PRIOR ART

In a known copier of the same type a number of copy paper sheet stacks are placed in the copy paper supply magazine after their packing has been removed outside the copier. The arrangement of two independent supply magazines in these apparatus permits the empty magazine in each case to be refilled during the copying operation (paper withdrawal from full magazine) so as to allow a continuous copying procedure.

The copy paper used therefor has been preconditioned by the manufacturer, that is to say it has been provided with a predetermined degree of atmospheric humidity and is packed in a, e.g. coated packing to prevent a change of the paper condition. The preconditioning of the copy paper ensures that its properties remain constant and that it can reliably be processed further. As soon as the copy paper is unpacked, its condition may change in response to the temperature and atmospheric humidity prevailing at the copier. In high atmospheric humidity, the copy sheets may become undulated or stick to one another. In low atmospheric humidity and/or high temperatures the copy sheets dry out, so that their flexibility is reduced and the risk of a static charge build-up is increased. Such changes in the properties of the copy paper may cause malfunctions (paper jam).

As a result, in a copier of this type it is useful to make sure that no copy paper supply remains in the apparatus when it is intended to leave the apparatus unused for some time (weekend, holidays, vacation, and such like) since a copy paper supply remaining in the apparatus may lose its conditioning and thus cause malfunction of the copier.

It appears expedient to use newly unpacked preconditioned copy paper and to discard the remaining old copy paper when the copying machine has not been used for a longer period of time so that operation of the copier of the above mentioned type is not impaired by the use of improper copy paper.

This will become particularly costly when a large amount of copy paper is to be placed in a supply magazine of a copier. Discarding smaller amounts of copy paper is however not desired either.

It is the object of the invention to develop a copier of the above mentioned type such that a larger amount of copy paper can be placed in a supply magazine of the apparatus and protected from a change of the paper condition. Moreover, an adequate amount of copy paper must be readily available for immediate use.

SUMMARY OF THE INVENTION

According to the invention, the above object is attained in that the supply magazine holds copy paper stacks (copy paper packages) enclosed in their packings, in that the supply magazine is associated with an unpacking device for opening individual, closed copy paper packages and in that the unpacked copy paper stack is associated with the sheet separating device.

In an advantageous embodiment of the invention the unpacking device is directly associated with an end face of the copy paper package.

In a further advantageous embodiment of the invention the copy paper stack which has been unpacked in the unpacking station is engaged as a whole by a removing means and fed to the sheet separating device.

In another advantageous embodiment of the invention parts of the packing are completely separated and removed or partially separated and folded up by the unpacking device.

In yet another advantageous embodiment of the invention the section of the packing facing the opening device and/or the removing means is bulged out for free access of the above means.

In still another advantageous embodiment of the invention the copy paper stack, prior to opening its packing, is deformed (displaced) such that its end face which faces the opening device takes a concave shape.

In a final advantageous embodiment of the invention the opening device, the means for building out the section of the packing associated with said means and a suction device for removing the dust caused during the opening operation are designed as a joint unit moveable along the outer surface of the packing.

The use of the invention in a copier permits a larger amount of preconditioned copy paper contained in closed copy paper packages to be stored in the supply magazine of a copier and protected against a change of the paper condition. Only a limited quantity of unpacked copy paper is made available for immediate use. This increases the reliability of the copier as well as the continuous operation of high volume copiers.

The copier according to the invention may be left unused even over a longer period of time without impairing the properties of the copy paper stored therein in a closed package. Moreover, no manual skill is necessary for placing the copy paper packages in the supply magazine of the copier according to the invention since improper placing or damaging and/or soiling of the copy paper itself is impossible.

Additional features and advantages can be inferred from the description of embodiments of the invention shown in the accompanying drawings, in which:

FIG. 29 shows another method of opening a package;

FIG. 30 represents a further opening device for copy paper packages featuring a resiliently supported or resiliently designed cutting device; and FIG. 31 represents a rupturing method for a copy paper package.

DESCRIPTION OF THE PREFERRED EMBODIMENTS

Figure 1:
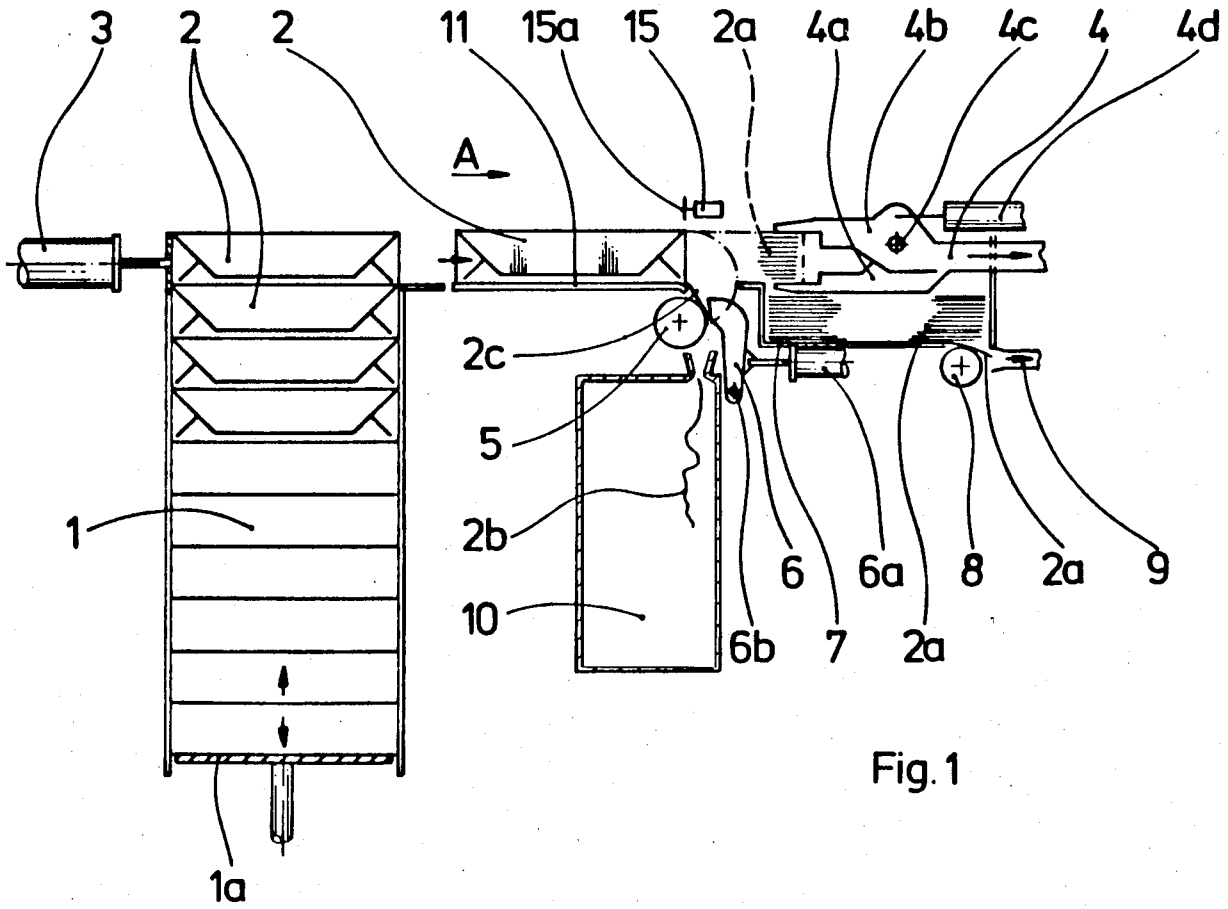
FIG. 1 shows a side view of the apparatus, partly in cross section.

A copying machine which for the purpose of a simplified representation of the invention only the details essential with respect to the invention are shown, contains a supply magazine 1 in which a plurality of copy paper packages 2 are stacked. The copy paper packages 2 are closed all around by the usual packing applied by the manufacturer. The copy paper has been preconditioned by the manufacturer, that is to say it has been provided with a predetermined degree of atmospheric humidity so that the requirements necessary for reliable paper handling are met.

The packing of the copy paper packages 2 is designed such (e.g. coated on the inner surface) that a change of the paper condition is prevented as long as the packing remains closed.

The packing encloses the copy paper stack, is folded at the end faces with its flaps overlapping each other and being hot-sealed.

The walls of supply magazine 1 are adapted to the size of the copy paper packages 2 such that said packages can be placed therein in a predetermined position only.

In the path of movement of the displacing device 3 or of the copy paper package 2 moved by said device an unpacking means is provided. According to FIGS. 1 and 2, the unpacking means is arranged around a support 11 for the copy paper package 2 to be unpacked and consists of suction means 12, 13, a sawing device 15 for opening the packing **2*b*, a claw device 4 for removing copy paperstack 2*a* from the opened packing 2*b*, and a means 5, 10** for removing the empty packing.

Two identical suction devices of a first type are provided which are arranged on he upper side and (not shown in the drawing) on the bottom side of the copy paper package 2. Essentially, the suction device consists of a sucker 12 mounted to pivot arms 14 and operated via hose **12*a***.

A suction device of a second type is associated with the end face **2*c* (to be opened) of packing 2*b* of the copy paper package 2. This suction device is provided with a sucker 13** which is pivotally supported by a means (not shown in the drawing) similar to said first suction device.

Figure 2:
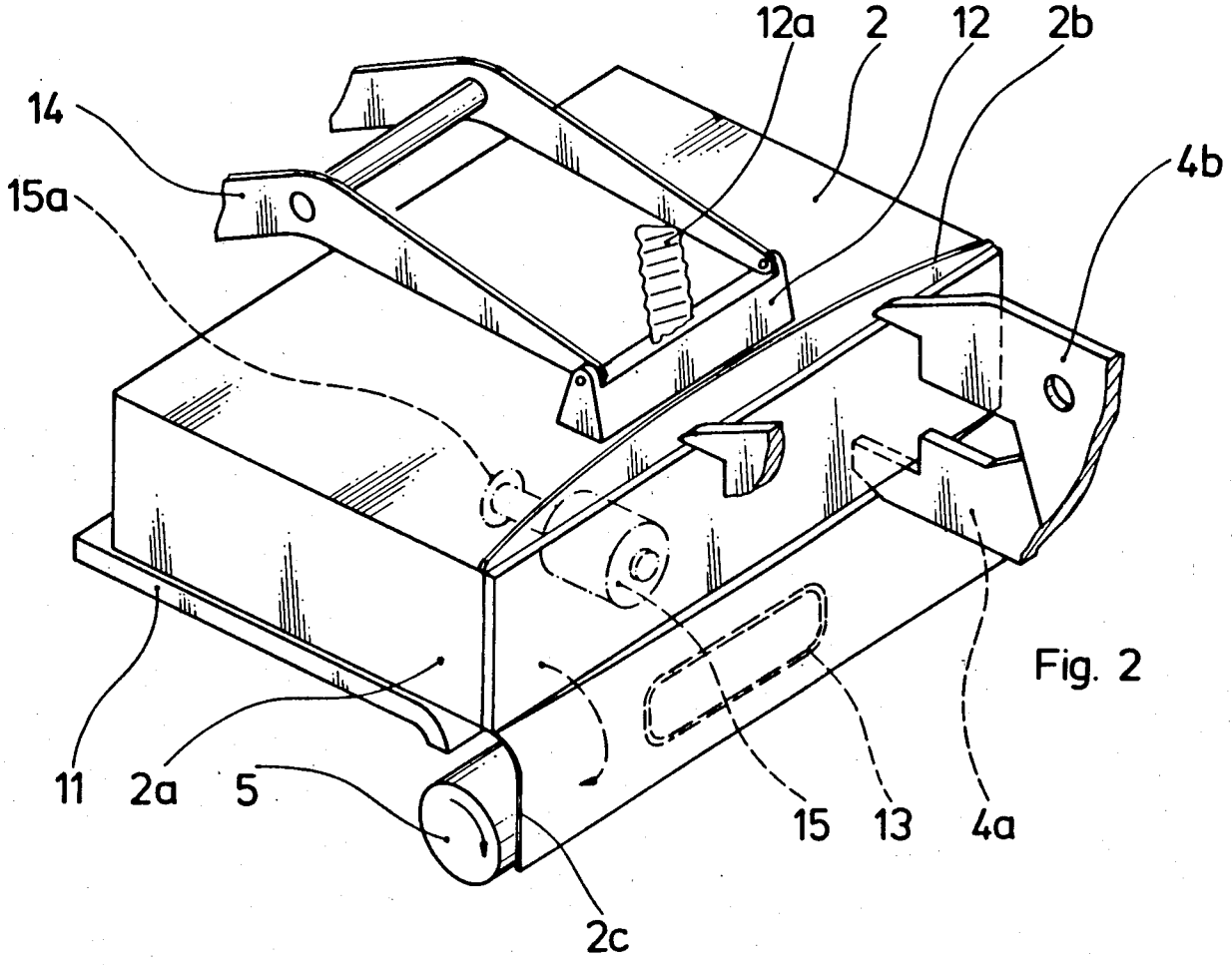
FIG. 2 shows a perspective view of the unpacking device according to FIG. 1.
Figure 4:
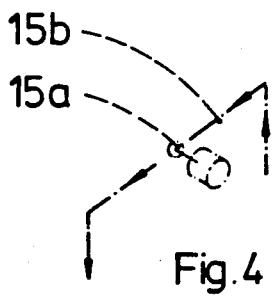
FIG. 4 shows the path of movement of the opening device shown in FIG. 2.

The sawing device 15 having a rotating circular saw **15*a* is guided in a guide path (not shown in the drawing) so as to be able to travel along a path of movement according to FIG. 4 noted by 15*b* which is associated with the end face of the copy paper package 2 and can best be seen in FIG. 2**.

The claw device is reciprocatable mounted in the path of movement of the topmost copy paper package 2. It comprises two claws 4 (only one claw 4 shown in the drawing) arranged next to one another, each having two gripping arms **4*a*, 4*b* which can be moved like a scissors by a lifting device 4*d***.

The means for removing the empty packing **2*b* consists substantially of a withdrawing roller 5, a pressure lever 6 which is pivotable about a fulcrum 6*b* by means of a lifting device 6*a*, and a scrap container 10**.

A magazine 7 is arranged beneath the path of movement of the topmost copy paper package 2 and, in the direction of movement thereof, next to the unpacking device 12, 13, 15 said magazine holding the unpacked copy paper stack **2*a*. The copy paper sheets are withdrawn from the bottom of stack 2*a* through an aperture provided at the bottom of magazine 7 by means of a sheet separating device 8 (not shown in detail in the drawing) of a known type, e.g. a suction roller. Further transport means of a known type designated 9** and not shown in detail in the drawing advance the separated copy sheets to the copying station of the copier.

Figure 3:
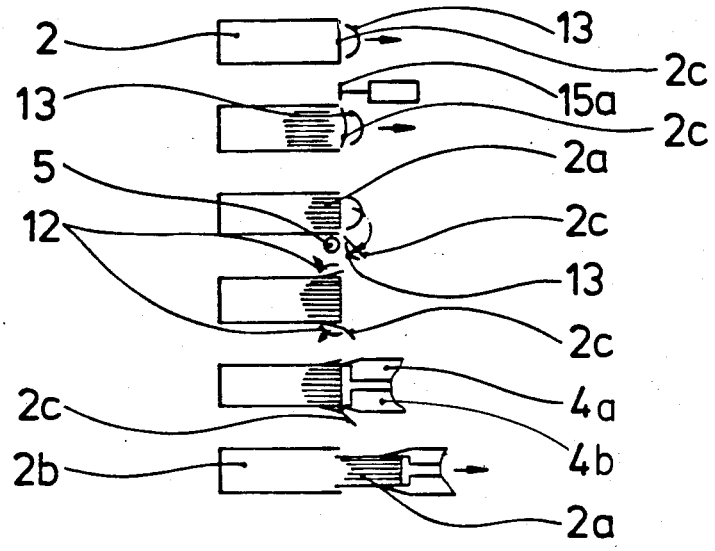
FIG. 3 shows the operating cycle of the unpacking device shown in FIG. 2.

The apparatus operates as follows:

Supply magazine 1 is filled with the copy paper packages 2 closed and sealed by the manufacturer. If supply magazine 1 is empty, bottom **1*a* thereof is in its upper position and moves downwards either stepwisely controlled or according to the weight of the paper loaded thereon by an amount corresponding to the height of the copy paper packages 2 placed on bottom 1*a*. The topmost copy paper package 2 remains in the path of movement of displacing means 3. By moving the displacing means 3 in the direction of arrow "A", the topmost copy paper package 2 is moved in the direction "A" onto support 11. The operating steps which now follow for unpacking the copy paper package 2 are shown in FIG. 3** from top to bottom in a schematic representation:

Sucker 13 is contacted with the part of packing **2*b* to be opened and a vacuum is applied to the sucker whereby the packing bulges out in the direction of the arrow and thus forms a cavity between packing 2*b* and copy paper stack 2**.

Circular saw **15*a* is moved so as to engaged packing 2*b* and is guided along the path shown in FIG. 4. In this way, packing 2*b* is opened so that a flap-like portion 2*c*** is formed.

Portion **2*c* of packing 2*b* is tilted downwards by sucker 13 and/or other suitable means, e.g. levers, sliders and such like, and pressed against the withdrawing roller 5 by means of the pressure lever 6 (FIG. 1**).

Suckers 12 are applied to the top and bottom sides of packing **2*b* so that it is expanded as can be seen from FIG. 2. Packing 2*b*** is thereby retained.

Gripping arms **4*a* and 4*b* are pushed into the cavities formed by the expanded packing 2*b* between copy paper stack 2*a* and packing 2*b* and moved toward each other by means of the lifting device 4*d***.

Claw 4 moves the complete copy paper stack **2*a* out of the packing 2*b* and feeds it to magazine 7. The free end of stack 2*a* sags into the magazine and the other end drops down when claw 4** has been opened and withdrawn.

The unpacking process having been completed, roller 5 is operated moving packing **2*b* into a scrap container 10. As soon as an unpacked copy paper stack 2*a*** is ready for use in magazine 7, the unpacking device is returned to its initial position so that the next copy paper package 2 can be unpacked in the above described manner.

The unpacking process for the next copy paper package 2 can be effected by automatic control so that it is not started until the copy paper stack 2*a* in magazine 7 has almost been used up. In this way, the preconditioning of the sealed copy paper is maintained until shortly before it is used.

The automatic control for initiating the unpacking process of the next copy paper package 2 can be deactivated manually if it is apparent (sheet supply indicator) that the supply of copy paper in magazine 7 is sufficient for the copies yet to be made before the apparatus is turned off for a longer period of time. This minimizes the loss of copy paper.

A second embodiment of an unpacking device is described with reference to FIGS. 5 and 6. This unpacking device is arranged at the same location as that according to FIG. 1, with like parts being provided with like reference numerals. The substantial difference of the unpacking device according to FIGS. 5 and 6 relative to that according to FIG. 1 is that packing 2*b* is opened in this case in such a way that its upper portion can be lifted and removed like the lid from a box. For opening the packing, a sawing device 17 is moved around the complete copy paper package 2 in a rectangular path. A rotating circular saw 17*a* cuts open packing 2*b* directly above the bottom 2*d* thereof. A vacuum-operated sucker 19 (see FIG. 5) is provided just as in the first embodiment so that the teeth of the circular saw 17*a* do not damage the copy paper stack 2*a* contained in package 2. Sucker 19 bulges out packing 2*b* so as to form a cavity between packing 2*b* and copy paper stack 2*a* for the engagement of saw 17*a*.

Sucker 19 and sawing device 17, 17*a* are designed as a jointly movable unit since the saw 17*a* has to be moved around the complete copy paper package 2. This unit is also used to suck off through a suction pipe 19*a* the sawing dust caused during the opening procedure of packing 2*b*.

When the packing 2*b* has been opened by means of the saw 17*a*, the separated upper portion of packing 2*b* is lifted and removed from copy paper stack 2*a* and thrown into a scrap container not shown in the drawing.

The remaining bottom 2*d* of packing 2*b* facing the claw 4 is bent downwards by means not shown in the drawing (e.g. levers, sliders of such like) and moved into the nip of the withdrawing rollers 18 which advance the bottom 2*d* of the packing into the scrap container 10 arranged thereunder. Then the unpacked copy paper stack 2*a* is carried by claw 4 from support 11 into the magazine 7 as already explained in the description relative to FIG. 1.

Figure 8:
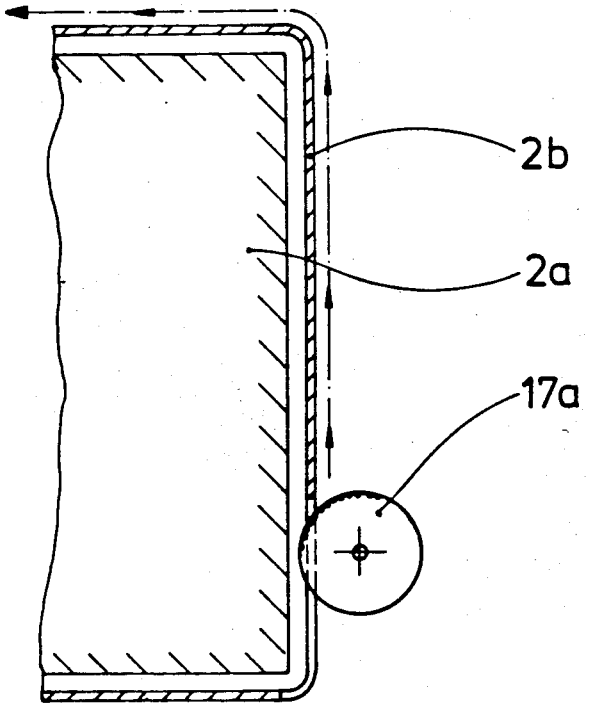

When the surface of packing 2*b* of copy paper package 2 is uneven (schematic representation in FIG. 8), portions of packing 2*b* may come very close to copy paper stack 2*a* so that only a small cutting depth is left for saw 17*a*. In order to prevent damage to the copy paper when opening packing 2*b* with saw 17*a*, said saw can be controlled by known sensors (not shown in the drawing) scanning the outer surface of packing 2*b* such that saw 17*a* follows the uneven outer contours of packing 2*b* at a constantly minimum cutting depth.

Figure 6:
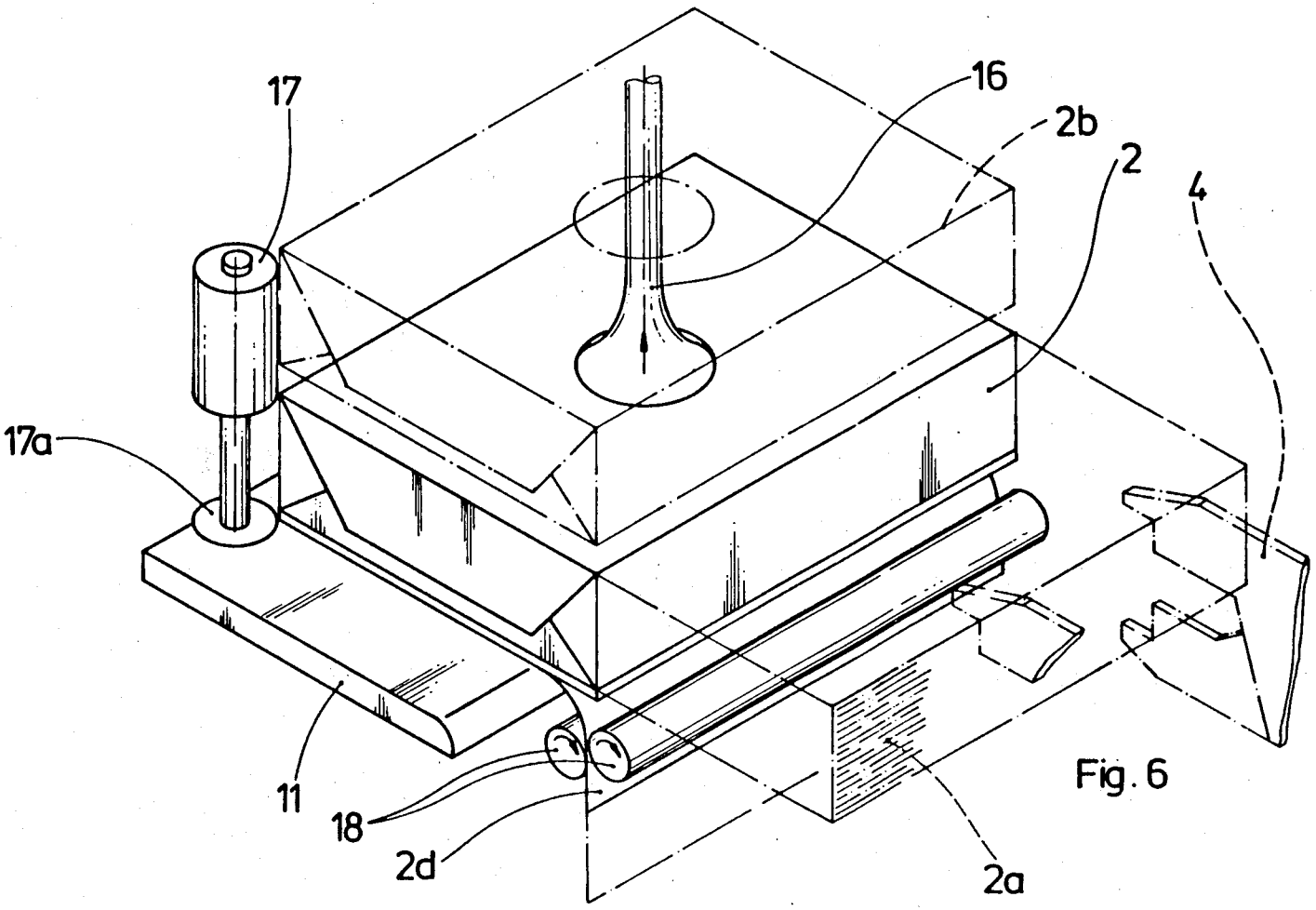
FIG. 6 shows a second embodiment of an unpacking device according to FIG. 1.
Figure 7:
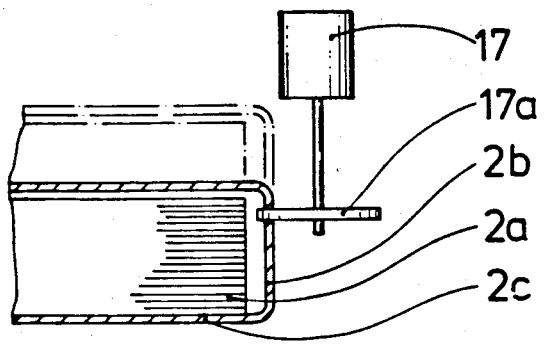
FIG. 7 and 8 shows a sensor-controlled opening device according to FIG. 2 or 6.

Such a sensor-controlled guidance of saw 17*a* can also be used for scanning the stack height if the packing 2*b* is to be opened above the copy paper stack 2*a* according to FIG. 7 and not at the lower bottom according to FIG. 6.

Figure 9:
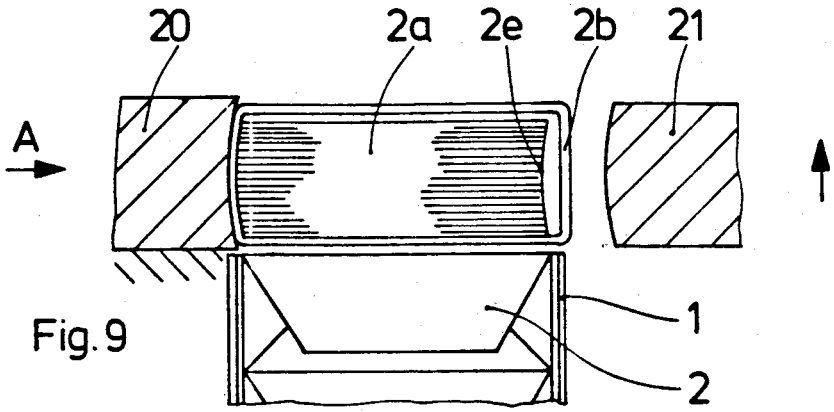
FIG. 9 shows a copy paper stack deforming device.
Figure 10:
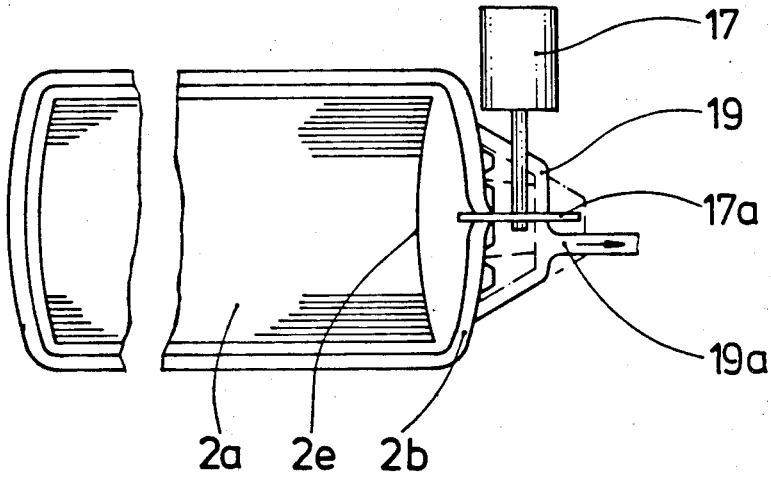
FIG. 10 shows a cross section of a copy paper package containing a deformed copy paper stack as shown in FIG. 9 and of an opening device shown in FIG. 5.
Figure 11:
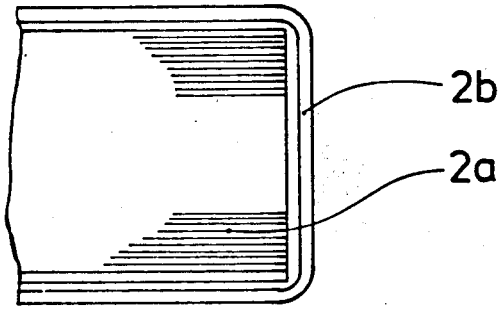
FIG. 11 shows a cross section of a copy paper package in normal condition (copy paper stack not deformed)

The copy paper package 2 can however also be opened in its central area between the upper and lower sides of the copy paper package 2, as shown in FIG. 10. In this case, the cavity between packing 2*b* and copy paper stack 2*a* can be enlarged in that the copy paper stack (FIG. 11) is deformed (displaced) such that a concavely shaped end face 2*e* of the stack according to FIGS. 9 and 10 is formed in the opening area.

The described deformation of the copy paper stack 2*a* is effected by a slider 20 which is shaped according to the desired design and presses the closed copy paper package 2 against an abutment member 21 shaped complementary to slider 20.

The deformation means 20, 21 shown in FIG. 9 in a schematic representation can be incorporated into the apparatus according to FIG. 1. The displacing means 3 would then have a concave end face similar to the end face on slider 20 according to FIG. 9. In the apparatus according to FIG. 1, an abutment member like member 21 in FIG. 9 is selectively moved into and out of the path of movement of the topmost copy paper package 2 between supply magazine 1 and support 11. The abutment member 21 may be rigid or resilient.

The described deformation of the copy paper stack 2*a* can also be effected pneumatically (not shown in the drawing).

It is also possible to effect the deformation of the copy paper stack 2*a* according to FIG. 9 such that the slider 20 is made to vibrate during the displacing movement (not shown in the drawing) and thereby deforms the copy paper stack 2*a*. Abutment member 21 can be eliminated in this case.

Figure 12:
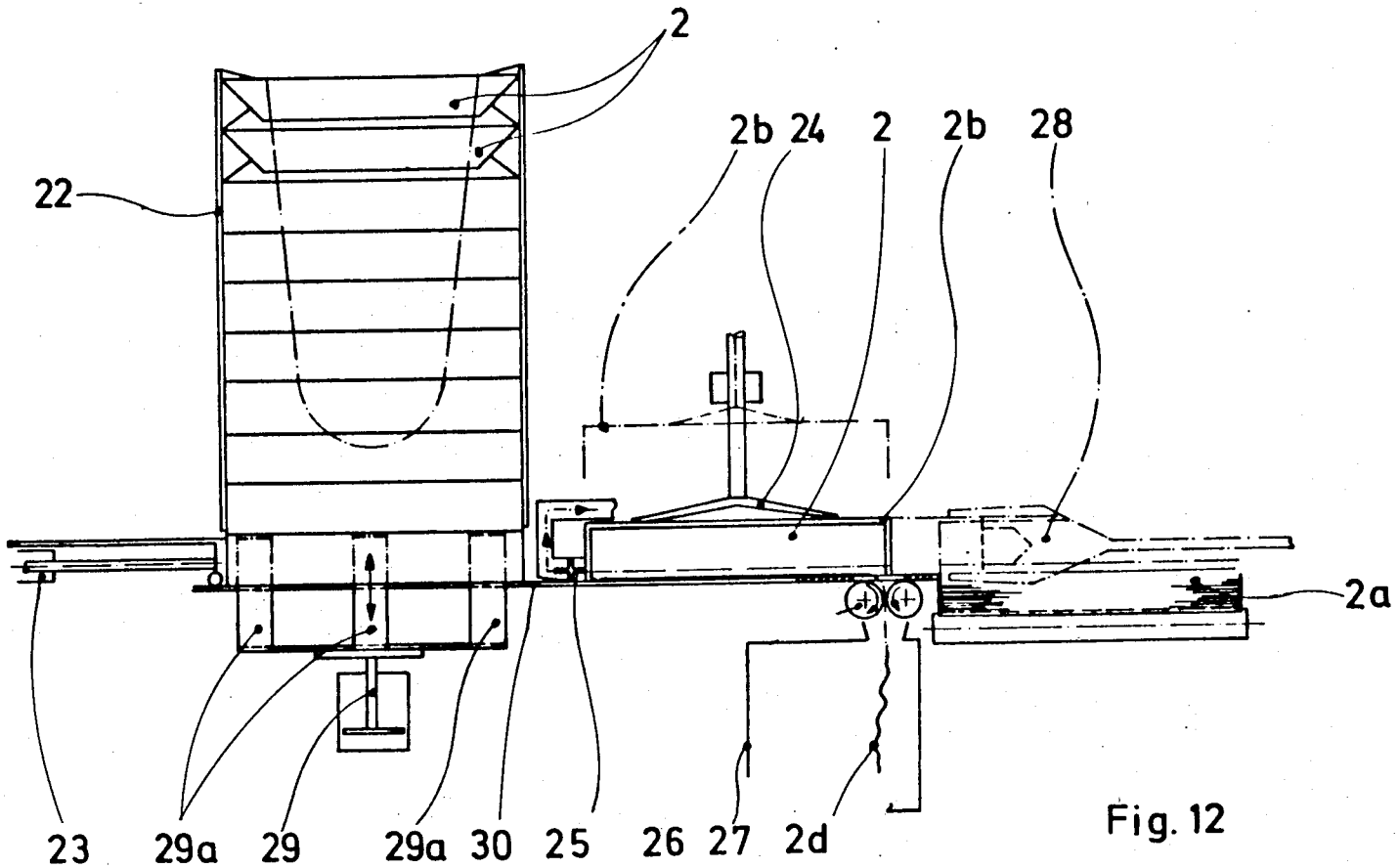
FIG. 12 shows a side view of a second embodiment of the apparatus featuring copy paper package removal from the bottom of the stack.

Contrary to the embodiment according to FIG. 1, in which the topmost of the copy paper packages 2 are stacked in supply magazine 1 withdrawn and unpacked, the withdrawal of the copy paper package 2 to be unpacked in the embodiment shown in FIG. 12 is effected at the bottom of the stack.

For this purpose, the apparatus according to FIG. 12 is provided with a raisable and lowerable lifting device 29 arranged beneath the copy paper supply magazine 22, and a displacing device 23 which has a plurality of L-shaped support members 29*a* embracing a slide path 30 defining the bottom of the supply magazine 22. The support members 29*a* are designed so as to be pivotable into and out of the supply magazine 22 in a manner not shown in the drawing.

The unpacking device has an opening device designed according to FIG. 6 and provided with a suction and sawing device 25, a sucker 24, a claw 28, withdrawing rollers 26, and a scrap container 27.

The apparatus according to FIG. 12 operates as follows:

The lifting device 29 takes a position in which the support members 29*a* keep the stack of copy paper packages 2 raised to an extent that the lowermost copy paper package 2 is freely movable.

Figure 5:
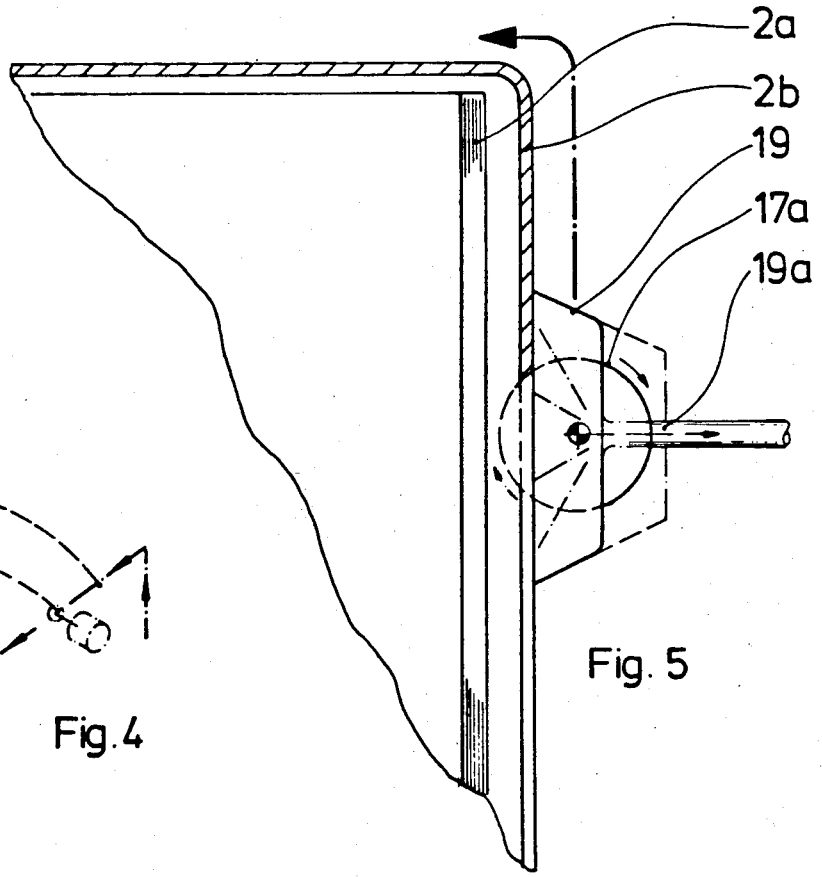
FIG. 5 shows details of the opening device shown in FIG. 2.

The displacing device 23 pushes the lowermost copy paper package 2 over the slide path 30 to the unpacking device in which the copy paper package 2, as already described relative to FIGS. 5 and 6, is opened by means of the suction and sawing device 25. The upper portion of the packing 2*b* is raised and removed by sucker 24. Then claw 28 moves the unpacked copy paper stack 2*a* to a sheet separating device, as for example shown in FIG. 1. The lower portion 2*d* of the packing is engaged by withdrawing rollers 26 and thrown into the scrap container 27. For lowering the next copy paper package 2, the lifting device 29 moves down and places the lowermost copy paper package 2 onto the slide path. Then the support members 29*a* are laterally retracted from the bottom of the copy paper stack and moved upwards by lifting device 29 outside the copy paper stack. Subsequently, the support members 29*a* pivot inwards again, engage with their turned-up end portions between the two lowermost copy paper packages 2 and raise the stack arranged thereabove to an extend that the lowermost copy paper package 2 is freely movable. Then the next unpacking procedure is effected.

Figure 13:
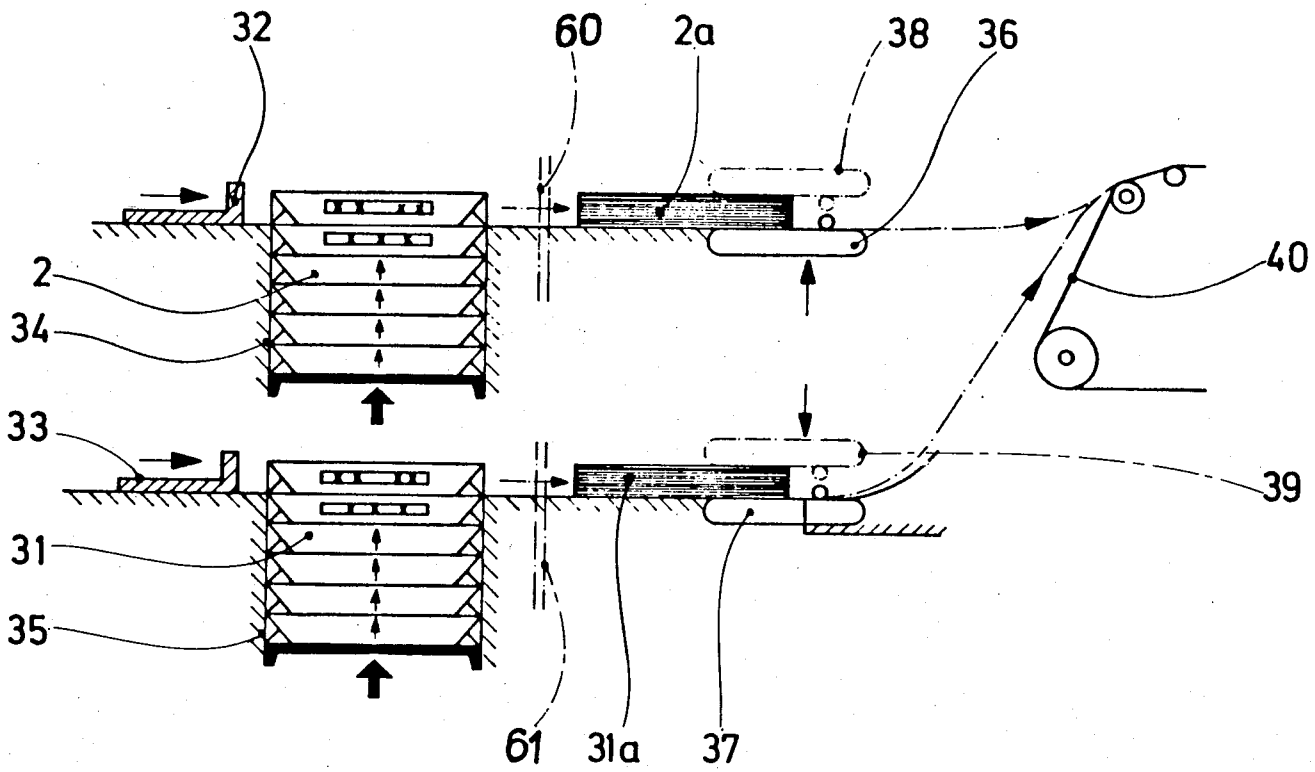
FIG. 13 shows the apparatus according to FIG. 1 featuring two supply magazines.

The copy paper packages 2 and 31—as shown in FIG. 13—are stored in separate supply magazines 34 and 35, if copy paper of different types, e.g. tinted and white and/or bearing pre-recorded information, is to be processed in a copier. Each of the supply magazines 34, 35 is associated with an unpacking device of the above-described type (in FIG. 13 the unpacking devices are indicated by the reference numerals 60 and 61 only).

Each unpacking device 60 and 61, respectively, is followed by a sheet separating device 36 and 37, respectively, which withdraw the copy sheets either from the bottom side or from the upper side 38, 39 (indicated in dash-dotted lines) of the unpacked copy paper stacks 2*a* and 31*a*, respectively. The separated copy paper sheets are fed to a copying station (not shown in the drawing) by means of a joint transport means 40, e.g. a photoconductive endless web.

Figure 14:
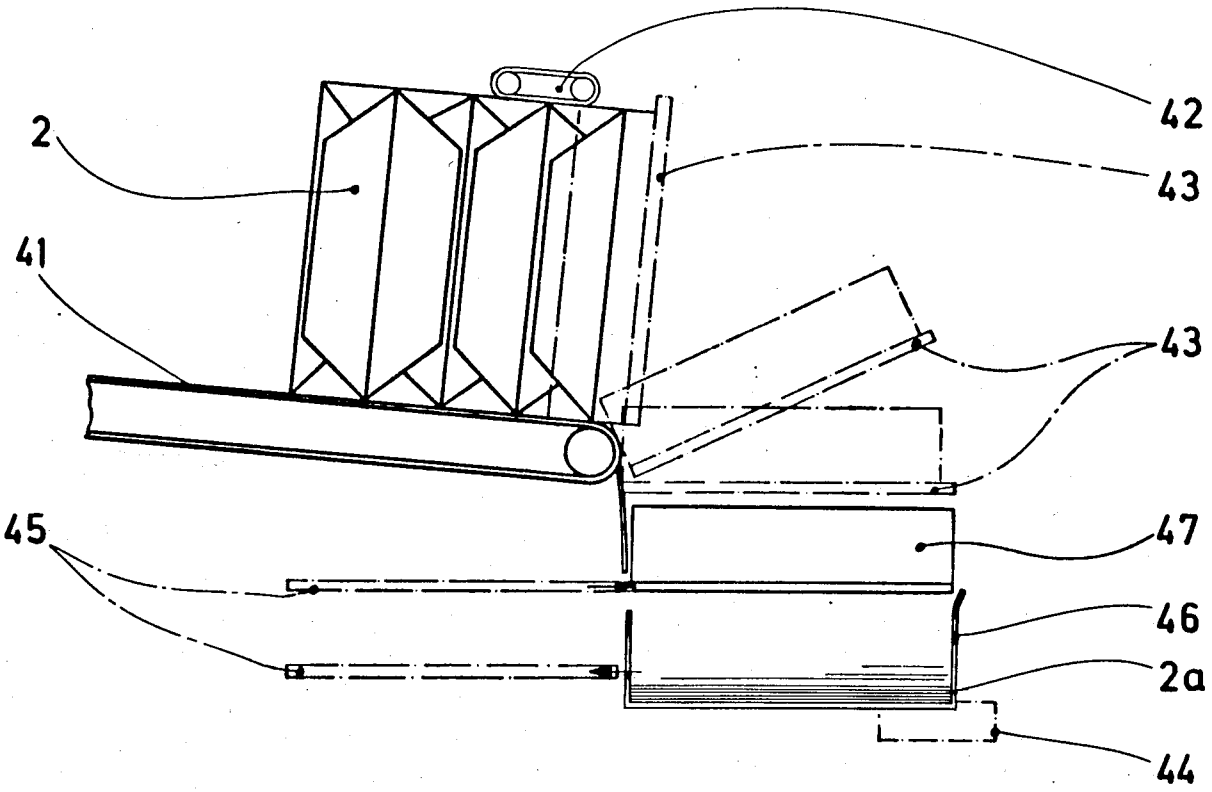
FIG. 14 shows a side view of a third embodiment of the apparatus holding copy paper packages stacked in upright position.

Unlike the described superposed arrangement of the copy paper packages 2 in supply magazine 1, 22, 34 and 35, said packages can also be juxtaposed (see FIG. 14). As shown in FIG. 14, the copy paper packages 2 are placed in an upright position side by side on a conveyor belt 41. The conveyor belt 41 is slightly inclined so that the copy paper packages 2 contact one another. A separating belt 42 arranged approximately parallel to the conveyor belt 41 and engaging above the copy paper packages 2 separates the front most package 2.

At the front side of the stack, the front most copy paper package is moved to an unpacking device 47 of the above-described type by means of a pivotable lowering plate 43. In the unpacking device the copy paper package 2 is placed onto a support 45 (indicated by dash-dotted lines) which is mounted so as to be transversely movable as well as liftable and lowerable. When the copy paper package has been unpacked, the support 45 is lowered and the paper stack is moved into a magazine 46 which is associated with a sheet separating device 44.

Other possibilities of opening a copy paper package 2 will be shown in the following paragraphs. In each case, only the principle will be schematically represented. Components which are not necessary for understanding the operation have been eliminated.

Figure 15:
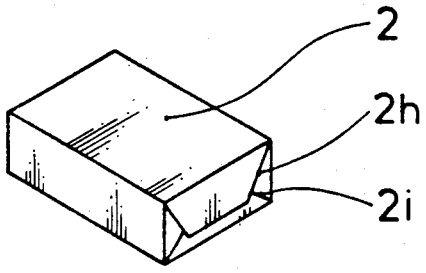
FIGS. 15 to 28 shows perspective views and top views, respectively, of the individual operating steps of a further embodiment of an opening device for copy paper packages.
Figure 16:
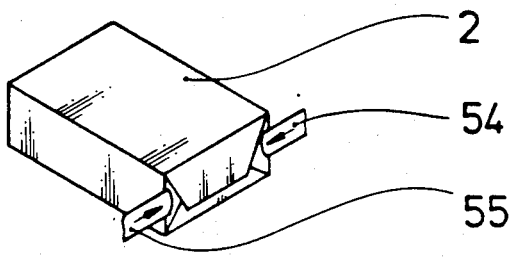
Figure 17:
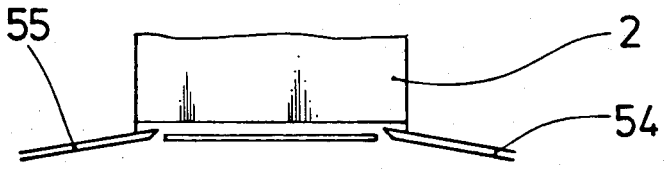
Figure 18:
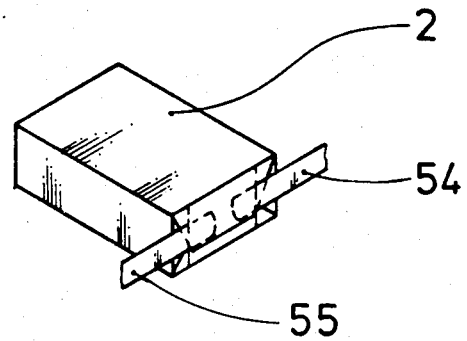

A packing as shown in FIG. 15 which is folded and adhered equally on both end faces is opened at one of the end faces while the packing is retained at the opposite end face. The copy paper stack 2*a* is engaged as a whole and pulled out of the packing by a claw device.

Figure 24:
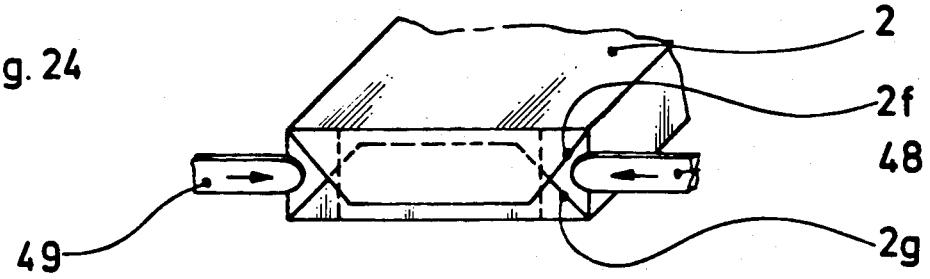
Figure 25:
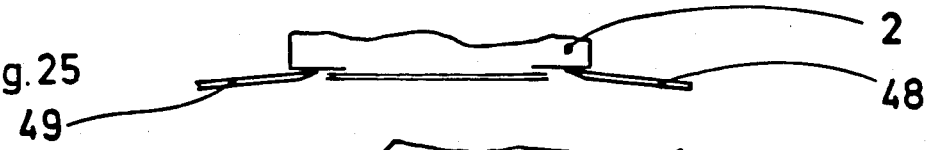
Figure 26:
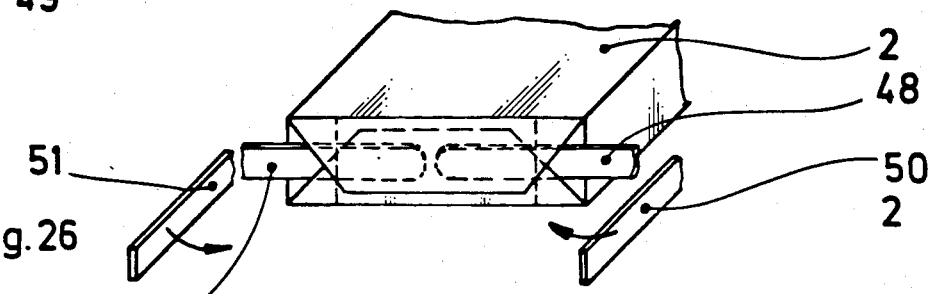
Figure 27:
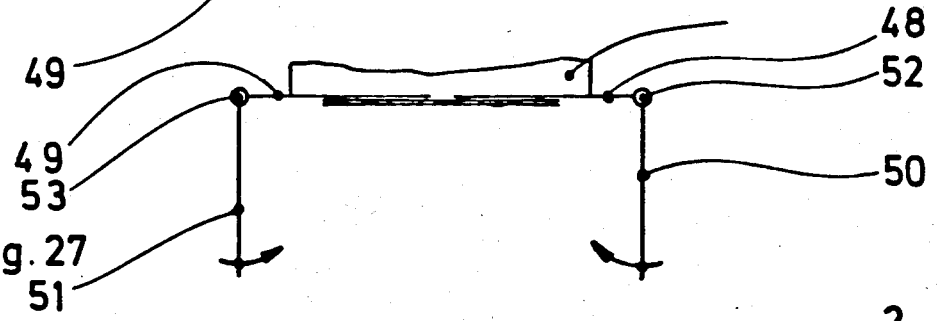
Figure 28:
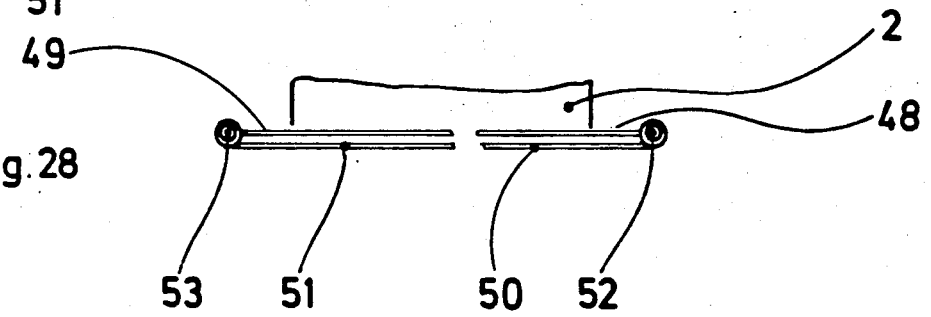

For retaining the packing 2*b* of copy paper package 2 on one of the end faces of the package, two holding bars 48, 49 (shown in FIGS. 24 to 28) are pushed from opposite sides behind the overlapping flaps 2*f*, 2*g* of packing 2*b* (FIGS. 24 and 25). The holding bars 48 and 49 are provided with clamping arms 50, 51 which are pivotable about fulcrums 52, 53. When the holding bars 48, 49 have reached their end positions shown in FIGS. 26 and 27, the clamping arms 50, 51 are pivoted towards the packing. Thus, the packing is retained and clamped at this end face of the copy paper package 2 so that the packing can neither be pulled along nor burst open when said packing experiences a pulling force in the longitudinal direction of the copy paper package.

The actual opening procedure of the packing of copy paper package 2 will now be described with reference to FIGS. 15 to 23.

Figure 19:
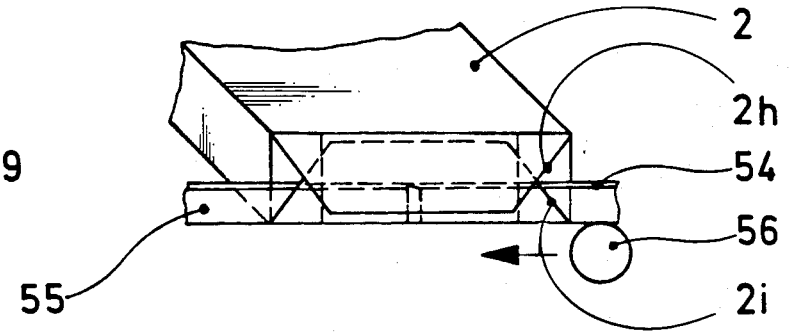

At the end face of the copy paper package 2 opposite to the holding device 48 to 53, two opening arms 54 and 55 are pushed from opposite sides behind the overlapping flaps 2*h*, 2*i* of the packing. In their pushed-in end position according to FIG. 18 the opening arms 54, 55 are moved to the lower position shown in FIG. 19. Then the packing is cut open by an opener 56 which submerges in a depression (not shown in the drawing) at the lower side of the opening arms 54 and 55 and is moved in the direction of the arrow as shown in FIG. 19. The opener 56 may be designed as a rotating cutting blade, saw blade or as a rigid knife.

Figure 20:
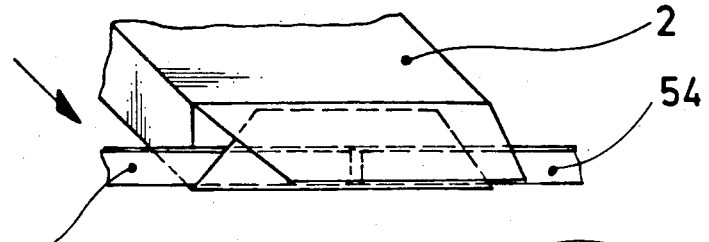
Figure 21:
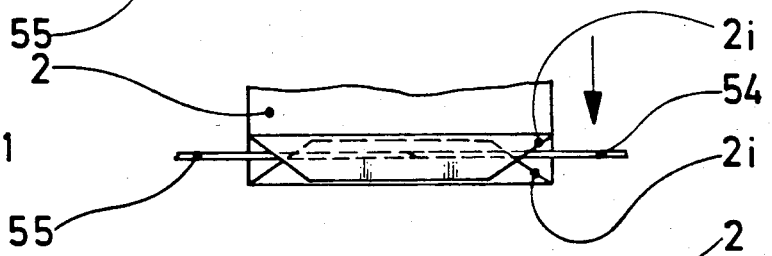
Figure 22:
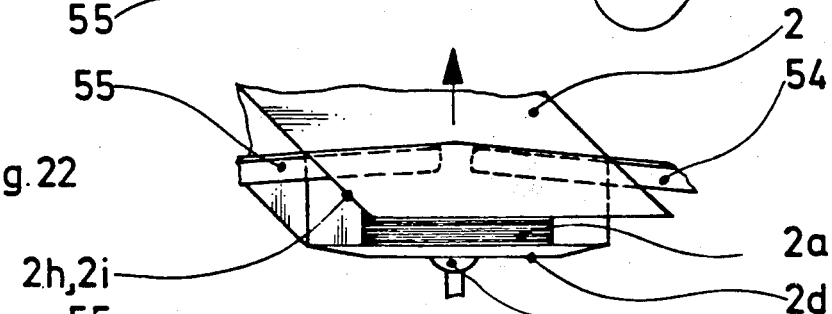
Figure 23:
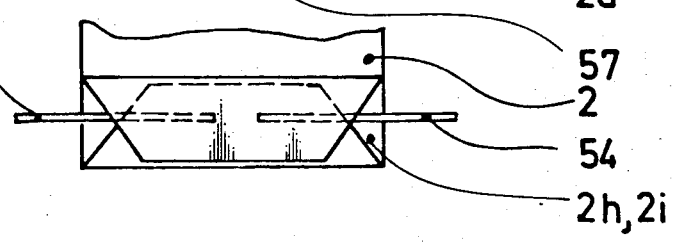

When the packing has been cut open as described, the opening arms 54, 55 are moved a bit forward in the direction of the arrow shown in FIGS. 20 and 21 and then upwards in the direction of the arrow shown in FIG. 22. The packing portions 2*h* and 2*i* cut open which, due to their being adhered to each other, form a connected, flap-like pivotable part of the packing are thereby first pivoted open a small amount (FIGS. 20 and 21) and then fully lifted up (FIGS. 22, 23). In their end positions which can be seen particularly from FIG. 22, the opening arms 54, 55 take an inclined position such that the upper portion of he packing forms a cavity towards the copy paper stack 2*a*.

Due to the fact that a sucker 57 is applied to the bottom 2*d* of packing 2*b*, a cavity is formed also at the bottom side of the copy paper package 2.

Now the unpacked copy paper stack 2*a* can be withdrawn by means of a claw 4, according to FIG. 2, entering said cavities. The packing as already described is retained by the holding device 49 to 51. When the copy paper stack 2*a* has been withdrawn, it is fed as already described hereinabove to a sheet separating device.

As soon as the holding device 48 to 51 is separated from the empty packing, said packing is thrown into a scrap container by means not shown in the drawing.

As shown in FIG. 29, the copy paper package 2 can also be opened such that the packing portion 2*k* cut open at the end face is pivoted about a short edge of the package.

Also the following means which are not shown in the drawing can be used for cutting the copy paper package 2 open:

a cutting wire optionally heated or a cutting bar which severs one end face of the packing;

a cutting bar which is pushed behind an end face of the packing and then moved transversely thereto.

Another possibility for opening a copy paper package 2 is shown in FIG. 30 which is especially advantageous when the depth of the cavity between packing 2*b* and copy paper stack 2*a* is very small. In this case, a cutting tool 58 is provided which is either flexible in itself and/or resiliently supported. Tool 58 when penetrating packing 2*b* moves between the individual copy paper sheets without damaging them.

The packing of a copy paper package 2 can also be opened without the use of an opening tool penetrating the packing. For this purpose, an adhesive tape 59 is pressed onto a surface of copy paper package 2 by appropriate means (e.g. a roller) not shown in the drawing. The packing is ruptured by removing the adhesive tape 59. Subsequently, the opened packing is expanded and emptied, e.g. as shown in FIG. 2.

It is also possible to open the packing of a copy paper package by moistening or heating the adhered sections of the packing. The opened packing can then be expanded by appropriate means such as levers, rollers or the like so that the copy paper stack can be withdrawn.

The packing of the copy paper package 2 can also be provided with a zipper type closure (not shown in the drawing) which is opened by appropriate means in the unpacking station.

The packing of the copy paper packages may also consist of a shrink foil of a known type (not shown) which is cut or ruptured open by suitable means in the unpacking station.

The above described supply magazine with the associated unpacking station may both be mounted in a copier consisting of one unit and designed as a separate module that can be attached to and thus form a unit with the actual copier.

What is claimed is:

1. In a reproduction machine for making visible representation of information on paper sheets fed by a sheet separating device from a sheet supply, means for refilling said sheet supply comprising:

a container containing a plurality of fully closed packaged paper stacks;

means for removing a packaged paper stack from said container;

means for receiving a packaged paper stack and opening the packaging thereof;

means for gripping the paper stack within an opened package, said gripping means being movable to a position associated with said sheet supply to remove the stack from its opened package and transport the stack into operative association with the sheet separating device for feeding such sheets seriatem to have information reproduced thereon.

2. The invention of claim 1 wherein said receiving and opening means comprises cutting means movable along a path for slicing through the packaging of the packaged stack to facilitate removal of the stack from the packaging by said gripper means.

3. The invention of claim 2 wherein said receiving and opening means comprises means for deforming a portion of the periphery of the packaging in the vicinity of the path of said cutting means to separate the stack from contact with said cutting means when slicing through the packaging.

4. The invention of claim 3 wherein said deforming means comprises means for applying a vacuum to the packaging of the packaged stack to provide space between the stack and the packaging for operation of the cutting means.

5. The invention of claim 1 further comprising means for discharging the packaging of the packaged stack following removal of such stack from such packaging.

6. The invention of claim 1 and wherein said gripping means comprises means for engaging the front and back sheets of the packaged stack to hold the sheets of the stack together.

7. In combination, an electrophotographic reproducing device having means for establishing visible representations of information, means for transferring such representations to sheets, and means for feeding seriatem sheets from a stack to said transferring means to receive such representations; and a stack handling apparatus comprising:

a magazine adapted to store fully closed packaged stacks of sheets;

means for removing a packaged stack from said magazine;

means for receiving such removed stack;

means for opening the packaging of such packaged stack and physically removing the stack from the opened packaging; and means for positioning the removed stack in sheet feeding relation to said feeding means.

* * * * *